US005618099A

United States Patent [19]

Brubacher

[11] Patent Number: 5,618,099

[45] Date of Patent: Apr. 8, 1997

[54] SIGHTING DEVICE

[76] Inventor: Michael Brubacher, 6222 Janice Wy., Scottsdale, Ariz. 85254

[21] Appl. No.: 283,383

[22] Filed: Jul. 29, 1994

[51] Int. Cl.[6] ..... F41G 1/35

[52] U.S. Cl. ..... 362/111; 362/187; 362/190; 362/259; 33/234; 33/241

[58] Field of Search ..... 33/234, 241, 286, 33/DIG. 21; 362/110–114, 187, 190, 191, 205, 259

[56] References Cited

U.S. PATENT DOCUMENTS

| | | | |
|---|---|---|---|
| 3,510,965 | 5/1970 | Rhea | 362/111 |
| 3,526,972 | 9/1970 | Sumpf | 362/111 |
| 4,136,956 | 1/1979 | Eichweber | 362/111 |
| 4,830,617 | 5/1989 | Hancox et al. | 362/111 |
| 5,124,892 | 6/1992 | Lambert | 362/205 |
| 5,343,376 | 8/1994 | Huang | 362/259 |
| 5,365,669 | 11/1994 | Rustick et al. | 33/234 |
| 5,454,168 | 10/1995 | Langner | 33/234 |

*Primary Examiner*—Alan Cariaso
*Attorney, Agent, or Firm*—Gregory J. Nelson

[57] ABSTRACT

A sighting device positionable in the end of the bore of a shotgun which emits a beam of light which simulates a shot pattern. The device has a tubular body which is held in the bore by a biasing spring. The body includes a light source, preferably a laser diode, which emits a beam. The beam may be focused at an adjustable lens and may be adjusted so the beam of light is aligned with the axis of the bore. An actuating switch may be secured to a finger of the user or to the shotgun.

15 Claims, 2 Drawing Sheets

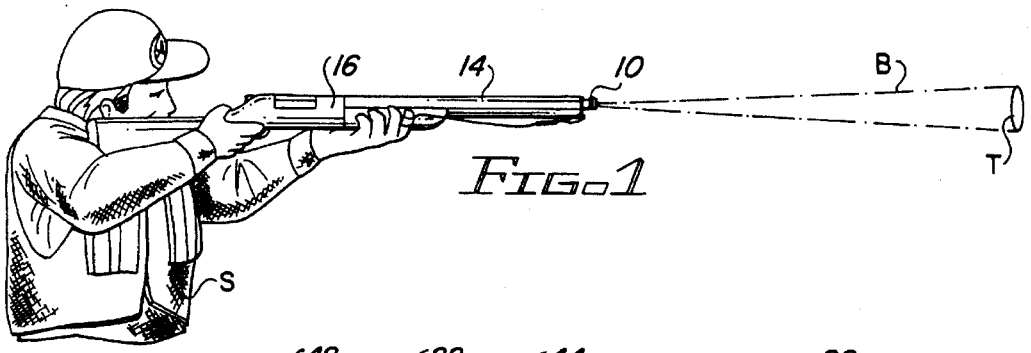
FIG. 1
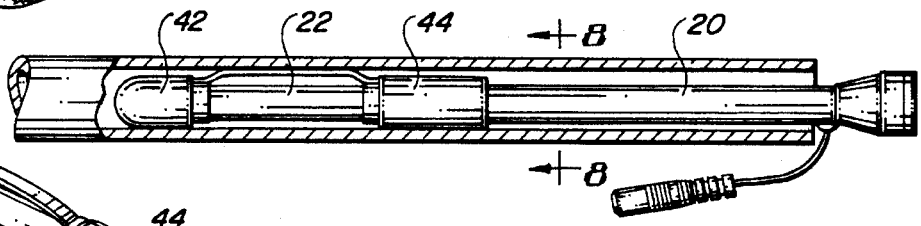
FIG. 2
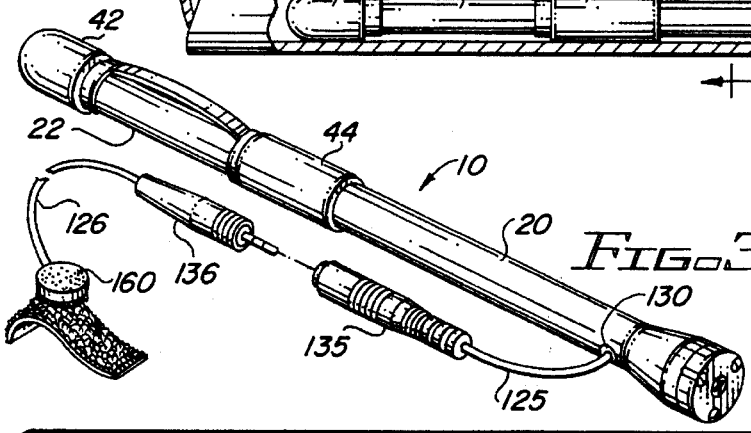
FIG. 3
FIG. 4
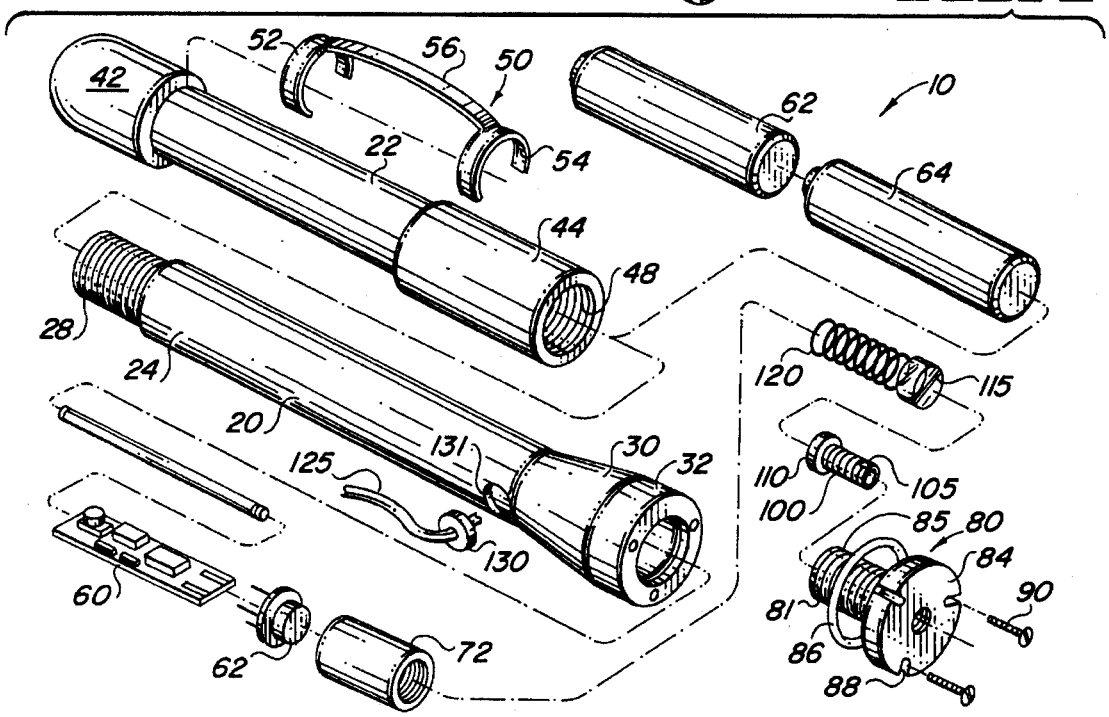

SIGHTING DEVICE

FIELD OF THE INVENTION

The present invention relates to an optical sighting device which is positionable within the barrel of a firearm such as a shotgun and which emits a beam of light. More particularly, the invention relates to an optical device which, upon actuation, projects a beam of light which simulates the pattern or path of a shell discharged from a shotgun or other firearm.

BACKGROUND OF THE INVENTION

As most firearm shooters know, a fundamental element of shooting requires that the eye and the end of the barrel be directed to the same target point at the moment the trigger is pulled. If the shooter's eye and the firearm barrel are not converged on the target, the target will be missed. The present invention is an optical device which emits a beam of light which assists in training the shooter to properly direct the firearm in relationship to the shooting posture of the individual shooter. Various shooters hold firearms in different positions which, along with physical differences of the shooters, will affect the line of fire. With the present system, a shooter can develop an accurate, repeatable shooting posture through practice.

In addition to assisting the shooter in improving shooting skills, the sighting device of the present invention can also assist the shooter in initially "sighting" a shotgun.

The sighting device of the present invention can be used as an impact or training system as described above which helps individuals in developing accurate, repeatable shooting postures. In the impact or training mode of operation, the device will emit a continuous laser light beam for as long as the operator or shooter maintains pressure on the triggering switch.

In another mode, the present invention may be used as a field device for improving shooting skills and also for competitive practice. As a field device, the device allows the firearm to be aimed duplicating actual shooting conditions that may be encountered in bird hunting or trial shooting. A switch allows a pulse of light to be generated instead of a continuous beam of light.

SUMMARY OF THE INVENTION

Briefly the above objects are accomplished by a device which is insertable in the choke end of a shotgun barrel. The device may be sized for various gauges of shotguns such as a 20 gauge or 12 gauge shotgun. The device has an elongated tubular body having front and rear sections which are detachably connected at an intermediate location. Cylindrical lugs are arranged at spaced-apart locations about the body of the device having an outer diameter slightly less than the internal diameter of the shotgun bore. The tubular body carries an external spring which engages the bore of the barrel to properly seat the device in precise alignment with the axis of the bore. The body contains a power source such as batteries, a light-emitting circuit including a light source and an objective lens. The lens is mounted so that the focal length of the lens can be adjusted to provide the desired pattern simulating the pattern of a shotgun. The lens housing is also adjustable so that it may be calibrated so that the beam of light emitted is properly aligned with the axis of the bore of the shotgun.

BRIEF DESCRIPTION OF THE DRAWINGS

The above and other objects and advantages of the present invention will become more readily apparent from the following description, claims and drawings in which:

FIG. 1 depicts a shooter aiming a shotgun equipped with the sighting device of the present invention;

FIG. 2 is a view of the end of a shotgun partly broken away to illustrate the position of the sighting device in the end of the bore;

FIG. 3 is a perspective view of the sighting device of the present invention;

FIG. 4 is an exploded perspective view of the sighting device of the present invention;

DESCRIPTION OF THE PREFERRED EMBODIMENT

Figure 5:
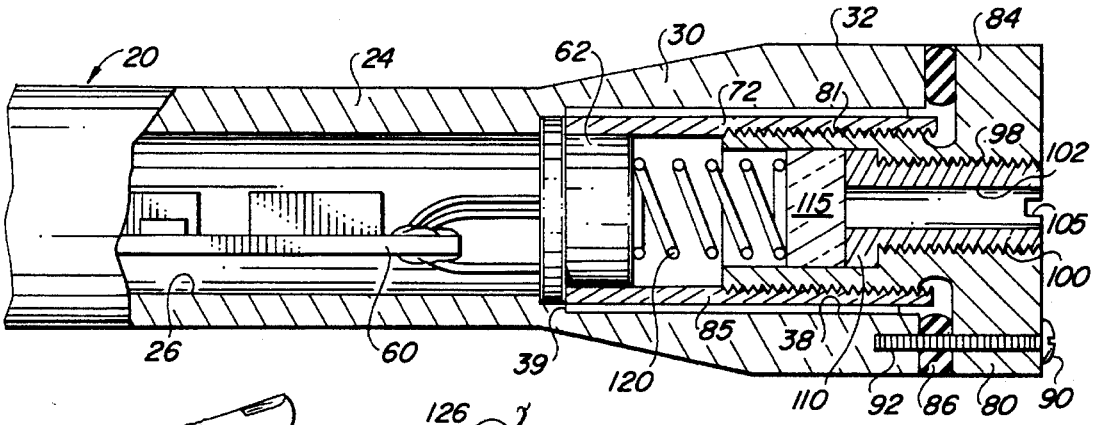
FIG. 5 an enlarged detail view of the outer end of the sighting device of the present invention.
Figure 6:
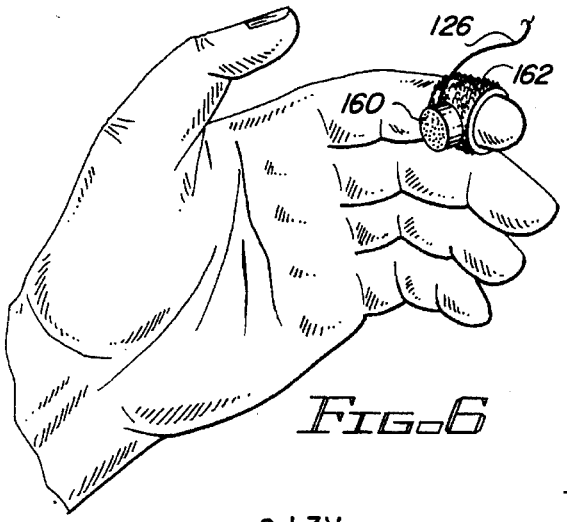
FIG. 6 illustrates a shooter's hand showing an actuating switch carried on the first finger.

The sighting device of the present invention is generally designated by the numeral 10 and in FIG. 1 the device is shown inserted in the end of the barrel 14 of shotgun 16. The shooter 5 is shown aiming the shotgun 16. The sighting device 10 projects a beam of light B which at the target has spread in a pattern "P" representative of the pattern of a shotgun shell fired by a shotgun 16.

Referring to FIGS. 1 to 5, the body of the sighting device 10 has a front tube 20 and a rear tube 22. The front tube 20 has a generally elongated tubular body 24 defining an internal cylindrical chamber 26. The rear end of the front tube 20 is threaded at 28. The front end of tube 20 tapers outwardly to a head 30 having an annular rim 32 of a diameter greater than the front tube. A counter bore 38 extends rearwardly from the opening in the head 30 terminating at shoulder 39 at the intersection with bore 26.

The rear tube 22 has an end lug cap 42 which is generally cylindrical having a diameter slightly less than the diameter of a bore of a shotgun with which the device is to be used. Another lug 44 is positioned at the forward end of the rear tube having a diameter corresponding to the diameter of lug 42. The diameter of lugs 42 and 44 are, for example, in the case of a standard 12 gauge shotgun, approximately 0.050 inches less in diameter than the diameter of the shotgun or approximately 0.680 inches in diameter. This allows the device to be easily inserted into the bore of the shotgun at the choke end of the barrel and is supported by resting on a part of the circumference of the lugs. Lug 44 is provided with internal threads 48 which permit the front tube 20 to be placed in threaded engagement with the rear tube at threads 48 and 28.

Figure 8:
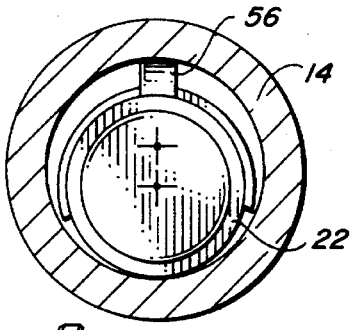
FIG. 8 is a sectional view taken along line 8—8 of FIG. 2.

A retention spring assembly 50 secures the sighting device in place in the bore as best seen in FIG. 2. The spring assembly includes a pair of spaced-apart, semicircular clips 52 and 54 with an arch shaped spring member 56 extending between the clips. The clips 52, 54 are positioned on the rear tube 22 with clip 52 adjacent lug 42. The spring 56 exerts a biasing force against the interior of the bore causing the sighting device to seat in the bore with the lugs engaging the bottom part of the bore, as best seen in FIGS. 2 and 8. In position, the longitudinal axis of the sighting device and the longitudinal axis of the bore are not precisely co-axial but are closely aligned and are parallel. The axis of the sighting device is vertically aligned with the axis of the bore as seen in FIG. 8 but is displaced a distance below the bore axis. This differential is so slight that it will not materially effect the accuracy of the device and the differential remains linear and is not compounded with distance.

The circuit components are mounted on PCB 60 and are connected to light source 62. Power for the circuit is provided by batteries 64 and 66 which for example may be conventional AAA alkaline batteries. The batteries are received within the battery chamber within the rear tube and are insertable at 48. PCB 60 is positioned within the bore 26 in the front tube rearward of the head 32. The circuit board is electrically connected to light source 62 which is shown as a laser diode but may be an LED or other light source. The light source is received within cylindrical housing 72 which loosely fits into counter bore 38. An alignment cap 80 is positioned within the head of the front tube and has a body 85 which is in threaded engagement with the housing 72 at 81. The alignment cap has disc-like end member 84 which has a diameter generally corresponding to the diameter of rim 32. An annular gasket 86 is interposed between the end 84 and the head 30. End member 84 defines a plurality of radially extending slots 88, three being shown. The slots 88 extend inward from the periphery of the end and are adapted to receive screws 90 which are in threaded engagement with threaded bores 92 which extend axially in head 30 arranged about bore 38.

The end member 84 defines a threaded opening 98 centrally positioned within the member. An adjustment screw 100 has a body in threaded engagement with the opening 98. The adjustment screw also defines a central bore 102. Notches 105 are provided at the outer end of the body of the adjusting screw 100 to permit the adjusting screw to be rotated to advance or retract the screw with respect to threaded opening 98. The inner end of the screw carries a circular seat 110 against which lens 115 abuts. A compression spring 120 extends within the holder 72 between the light source 62 and the lens 115.

Switch 160 is connected to the PCB by means of cables 125 and 126. Cable 125 connects to the PCB through grommet 130 at bore 131 in the front tube. The opposite end of the cable 125 is provided with a female connector 135. As will be explained hereafter, the user may select an appropriate mode switch 160 to be connected to the device by cable 126 and connectors 135, 136 depending upon the desired mode of operation.

Figure 7:
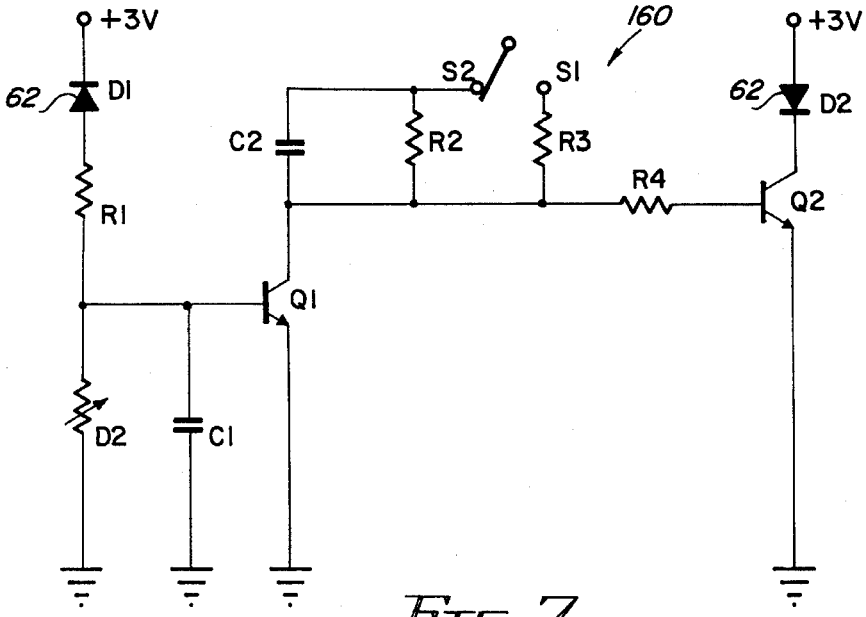
FIG. 7 is a schematic view of the light-emitting circuit.

The light-emitting circuit is best shown in FIG. 7 and as shown consists of a laser photo diode 62 having components $D_1$ and $D_2$, NPN transistors $Q_2$, fixed resistors $R_2$ and $R_4$, variable resistor $D_2$, and fixed capacitors $C_1$ and $C_2$. When energized, the laser diode 62 will emit a beam of light directed at lens 115. The light emitted from the lens is gathered within the light gathering tube 102 and projected from the outer end of the tube as generally concentric circles of light. The switch employed is shown as switch 160 and may be conveniently placed upon the first finger of the user by a band 162 which is shown having a conventional loop and hook fastener.

Alternately, the switch may be detachably secured by band 162 to the receiver or other part of the shotgun.

The switch 160 has cable 126 terminating at a male connector 136 which is engageable with female connector 135. Switch 160 may be selected to connect $S_1$ with a ground in which case the mode of operation is one in which a continuous beam of light is emitted. As an alternative, switch 160 can be selected so as to connect point $S_2$ with ground across capacitor $C_2$. In this operational mode, a pulse of light is generated rather than a continuous beam. The switch 160 operates to generate another pulse only when the shooter releases the switch and again depresses it. This mode, the field mode, duplicates firing an actual round as opposed to the continuous beam mode which is intended for sighting the gun and training the shooter in the proper shooting posture.

The lens 115 may be any suitable lens such as a molded plastic objective lens. One lens that has been found to work is a bi-asphere polycarbonate lens with a 1.2 millimeter diameter, a focal length at 4.6, numerical aperture 0.47, beam diameter 4.3 mm, and axial wave point distortion at 780 nanometers less than 0.02. A lens of this type is available from the optical products division of The Eastman Kodak Company in Rochester, N.Y.

Once the device is assembled as described above, it is generally necessary to calibrate the device, this can be done by placing the device in proper alignment tooling and energizing the light source 62. The set screws 90 are adjusted so that a beam of light is emitted from the end of the bore 102. The beam should be precisely aligned with the axis of the bore of the shotgun. The focal length of the device is adjusted by rotating the screw 100 until the desired pattern is obtained at the desired distance. For example, a typical calibration would be to set the device to project a generally circular pattern having approximately a 26" diameter at 30 yards which approximates the effective shot pattern area of a 12 gauge shotgun set at full choke at this distance. As mentioned above, the device of the present invention is intended to allow the shooter to sight a shotgun and also to practice shooting skills, both in target and field situations. The device may be used to project a simulated shotgun pattern on nearly any flat surface, although it may be helpful to use a target having a retroreflective surface.

In use, with the device inserted through the choke end of the shotgun as shown in FIG. 1 and with a continuous mode switch 160 positioned on the finger of the user, the switch is connected to the PCB at connectors 135, 136. The shooter will pick a point, as for example, on a flat surface 30 feet away and point the shotgun in a manner as if shooting the shotgun. The shooter will actuate the switch 160 and note the relationship between the aim point and the point where the laser beam impact indicates the barrel was actually pointing. The device will emit a very brief flash when the switch is actuated and the beam of light may be maintained by continuous actuation of the switch. This allows the shooter to adjust the gun to determine how various gun positions change the position of the laser light relative to the shooters line of sight. This enables the shooter to find the proper position that provides the most accuracy. Practice in this manner will enable the shooter to assume a better shooting and more accurate shooting posture.

The switch 160 can be replaced with a pulse switch simply by disconnecting connectors 135 and 165 and replacing the switch which will operate to energize the circuit across capacitor $C_2$. Use of a pulse mode enables the shooter to practice in a manner simulating actual field shooting or trap line shooting. With the pulse switch, a beam of light is emitted only with each depression of the switch, as for example for 22 milliseconds. Special retroreflective targets again may be helpful when these targets are struck by a beam of light, the target will return a bright red flash that is easily visible to the shooter.

The invention has been described with the preferred light source being a laser diode because of the desirable characteristics of laser light. However, other light sources such as LED's and even conventional flashlight bulbs may be used.

While the principles of the invention have been made clear in the illustrative embodiments set forth above, it will be obvious to those skilled in the art to make various modifications to the structure, arrangement, proportion, elements, materials and components used in the practice of the invention. To the extent that these various modifications do not depart from the spirit and scope of the appended claims, they are intended to be encompassed therein.

I claim:

1. A light-emitting sighting device positionable in a shotgun having a bore of predetermined diameter, said device comprising:

(a) a generally elongate body having a longitudinal axis and having a front end with an aperture therein, at least two spaced apart seating means on said body substantially the diameter of the shotgun bore;

(b) biasing means on said body intermediate said seating means engageable with the shotgun bore to removably position said device in the bore with the longitudinal axis of said body parallel to and spaced from the axis of the bore;

(c) light-emitting means in said body adapted to direct light through said aperture; and (d) switch means for selectively activating said light-emitting means.

2. The device of claim 1 wherein said light emitting means includes a laser diode, lens, light focusing means and alignment means.

3. The device of claim 1 wherein said body is generally tubular and wherein said seating means comprises at least two generally annular lugs spaced-apart on said body.

4. The device of claim 2 wherein said switch means energizes said light emitting means in continuous mode operation.

5. The device of claim 2 wherein said switch means is adapted to energize said light-emitting means in pulse mode operation.

6. The device of claim 1 wherein said switch is attached to said body by a cable and wherein said switch includes means for affixing the switch in a use position.

7. The device of claim I wherein said body is generally tubular and defines a battery chamber.

8. A light-emitting sighting device removably positionable in a shotgun having a bore with an axis and an outer end, said device comprising:

(a) a generally tubular body having a front and rear end, said body having annular seating means spaced-apart on said body;

(b) biasing means on said body engageable in said bore to position said body at the end of the bore in alignment with the axis of the bore;

(c) light-emitting means including power means and switch means; and (d) a cap having an aperture at said front end at the tubular body including lens means positioned to receive light from said light emitting means said cap being angularly adjustable with respect to said body and said lens being axially adjustable with respect to said tube to permit adjustment of the focal length of the lens and to simulate various shot patterns.

9. The device of claim 8 wherein said light-emitting means comprises a laser diode.

10. The device of claim 8 wherein said cap is secured to said body by a plurality of fasteners and wherein adjustment of said fasteners will adjust the axis of the light tube.

11. The device of claim 8 wherein said switch means is attached to said tubular body by a flexible cable.

12. The device of claim 11 including attachment means for securing said switch to a finger of the shooter.

13. The device of claim 12 wherein said attachment means comprises a fabric strap having hook and loop fasteners.

14. The device of claim 10 wherein said light tube is axially adjustable.

15. The device of claim 11 including attachment means for securing said switch to the shotgun.

* * * * *